US011458607B2

(12) United States Patent
Schweizer et al.

(10) Patent No.: US 11,458,607 B2
(45) Date of Patent: Oct. 4, 2022

(54) PRESS DEVICE

(71) Applicant: Von Arx AG, Sissach (CH)

(72) Inventors: Beat Schweizer, Titterten (CH); Andreas Stucki, Gelterkinden (CH); Marianne Heer, Sissach (CH)

(73) Assignee: Von ARX AG, Sissach (CH)

( * ) Notice: Subject to any disclaimer, the term of this patent is extended or adjusted under 35 U.S.C. 154(b) by 357 days.

(21) Appl. No.: 16/472,577

(22) PCT Filed: Dec. 19, 2017

(86) PCT No.: PCT/EP2017/083520
§ 371 (c)(1),
(2) Date: Jun. 21, 2019

(87) PCT Pub. No.: WO2018/114935
PCT Pub. Date: Jun. 28, 2018

(65) Prior Publication Data

US 2020/0094388 A1 Mar. 26, 2020

(30) Foreign Application Priority Data

Dec. 21, 2016 (EP) ..... 16205748

(51) Int. Cl.
*H01R 43/042* (2006.01)
*B25B 27/10* (2006.01)
*B21D 39/04* (2006.01)

(52) U.S. Cl.
CPC ..... *B25B 27/10* (2013.01); *B21D 39/048* (2013.01); *B21D 39/046* (2013.01); *H01R 43/042* (2013.01); *H01R 43/0428* (2013.01)

(58) Field of Classification Search
CPC .... B25B 27/10; B21D 39/048; B21D 39/046; H01R 43/042; H01R 43/0428
(Continued)

(56) References Cited

U.S. PATENT DOCUMENTS 3,345,856 A * 10/1967 Werner ..... H01R 43/042 72/409.13
5,931,067 A * 8/1999 Gold ..... B25B 7/12 81/407

(Continued)

FOREIGN PATENT DOCUMENTS

CN 103003004 A 3/2013
CN 104039247 A 9/2014

(Continued)

OTHER PUBLICATIONS

Chinese Office Action dated Jun. 29, 2020; Application No. CN 201780079688.9; 6 pages.

(Continued)

*Primary Examiner* — Sarang Afzali
*Assistant Examiner* — Darrell C Ford
(74) *Attorney, Agent, or Firm* — Mark E. Bandy; Rankin Hill & Clark, LLP

(57) ABSTRACT

A press device comprising a press ring for pressing together tubular workpieces in between, and at least a first and a second pivotable jaw is described. The jaws comprise engagement sections. The press ring comprises receiving sections for receiving the engagement sections of the press jaws. A first and a second surface of the receiving sections, contact the engagement sections. Each of the first and second surface comprises a planar surface. The engagement sections comprise contact surfaces. The contact surfaces oppose each other for applying a press force F. The contact surfaces each comprise at least one convex surface, such that a radius of curvature r of the first and the second contact surface is larger than half a width Wx, Wz, measured perpendicular to an axis of curvature, of the respective first and second contact surface.

15 Claims, 15 Drawing Sheets

(58) Field of Classification Search
USPC ..... 72/416
See application file for complete search history.

(56) References Cited

U.S. PATENT DOCUMENTS

| | | | | |
|---|---|---|---|---|
| 6,044,686 | A | 4/2000 | Dischler | |
| 6,164,106 | A * | 12/2000 | Nghiem | B21D 39/04 29/720 |
| 6,369,560 | B1 * | 4/2002 | Nghiem | B21D 39/046 320/136 |
| 6,634,202 | B1 * | 10/2003 | Oetiker | B25B 27/10 72/292 |
| 6,694,586 | B1 * | 2/2004 | Goop | B21D 39/046 29/234 |
| 6,923,037 | B2 * | 8/2005 | Bowles | B25B 27/10 29/237 |
| 7,578,159 | B2 * | 8/2009 | Bowles | B21D 39/048 72/409.01 |
| 7,878,790 | B2 * | 2/2011 | Kidd | B21D 39/048 425/318 |
| 11,060,637 | B2 * | 7/2021 | Takeda | F16L 23/06 |
| 11,185,907 | B2 * | 11/2021 | Schweizer | B21D 39/048 |
| 2003/0046973 | A1 * | 3/2003 | Hamm | B21D 39/04 72/452.8 |
| 2003/0230130 | A1 | 12/2003 | Bowles et al. | |
| 2005/0241359 | A1 * | 11/2005 | Viegener | B21D 39/046 72/416 |
| 2008/0022750 | A1 * | 1/2008 | Hamm | B25B 25/005 72/452.1 |
| 2008/0163664 | A1 * | 7/2008 | Battenfeld | B25B 27/10 72/409.12 |
| 2008/0216543 | A1 * | 9/2008 | Hamm | B25B 27/10 72/352 |
| 2009/0031778 | A1 * | 2/2009 | Hamm | B25B 25/005 72/407 |
| 2017/0225218 | A1 * | 8/2017 | Cho | F16L 23/04 |

FOREIGN PATENT DOCUMENTS

| | | | |
|---|---|---|---|
| DE | 202005008125 | U1 | 10/2006 |
| DE | 202006004876 | U1 | 8/2007 |
| EP | 1972394 | B1 | 4/2010 |

OTHER PUBLICATIONS

Extended European Search Report dated Jul. 13, 2017; App. EP 16205748.3; 9 pages.

* cited by examiner

PRESS DEVICE

FIELD

The present invention relates to a press device for pressing or crimping tubular workpieces together.

BACKGROUND

In the prior art, several techniques are known for connecting tubular workpieces like for example metal pipes. One of these methods is putting one pipe over the other and pressing both together, in some cases by means of an intermediate smaller tube. Other pipe connection systems use a pipe connector that is crimped together around inserted pipes. By this method a circumferential force is applied onto the surface of the outer pipe or connector by means of a press tool in order to apply a high crimping force that leads to an inelastic deformation. Press jaws of the press tool encompass the outer pipe or connector and can apply high forces. The press jaws can be applied manually by handles or electrically by using an electric motor to generate the crimp force. In some cases, the diameter of the outer pipe or connector, respectively, may be large. Then, it is not practical to encompass the whole circumference of the pipe by the press jaws, but rather use a press ring that is actuated by press jaws.

The usage of a press ring enables the crimping of tubular workpieces with an arbitrary diameter. Simply the diameter of the press ring has to be adjusted to the diameter of the workpiece. Then the press ring can be pressed together by means of a usually sized press tool. The press tool itself remains the same independent of the size of the tubular workpiece. As for many tools, also the press tool shall be usable a lot of times. Thus, damages and abrasions on the tools, i.e. the press ring and the press tool, shall be prevented.

Document DE 20 2006 004 876 U1 describes a pressing tool with a pressing ring and pressing tongs that are associated with pairs of cooperating engagement surfaces, wherein one engagement surface of each pair is flat and the other curved. Thereby, the curved engagement surface is concave, in particular substantially formed as part of an outer surface of a cylinder, a barrel or a ball.

Document US 2003/230 130 A1 describes assemblies for articulating a crimp ring for crimping a fitting relative to an actuator for actuating the crimp ring. Thereby, embodiments include for example articulating assemblies using ball and sockets.

During the pressing or crimping process, high forces are required to impose the inelastic deformation of the metal workpieces. Thus, usual press tools show a significant tendency to wear off. Thus, it is the problem underlying the present invention to provide a press device that uses press jaws that have a better wear resistance.

SUMMARY

The above-mentioned problems are solved according to the invention by a press device as described herein.

In particular, the above-mentioned problems are solved by a press device, comprising a press ring for pressing together tubular workpieces in between, and at least a first and a second pivotable jaw, wherein the first jaw comprises a first engagement section and the second jaw comprises a second engagement section, and the press ring comprises a first and a second receiving section for receiving the first and the second engagement section of the press jaws, respectively, wherein a first and a second surface of the first and the second receiving section, respectively, contacting the first and the second engagement section, respectively, each comprise a planar surface, and the first engagement section comprises a first contact surface and the second engagement section comprises a second contact surface, wherein the first and the second contact surface oppose each other for applying a press force, wherein the first contact surface and the second contact surface each comprise at least one convex surface, wherein a radius of curvature of the first and the second contact surface is larger than half a width, measured perpendicular to an axis of curvature, of the respective first and second contact surface.

By using a press ring in combination with press jaws tubular workpieces like pipes or pipe connectors with a larger diameter, i.e. preferably up to 150 mm, more preferably up to 180 mm, and most preferably up to 250 mm in diameter, can be pressed together without the need that the press jaws themselves have to encompass the whole workpiece. The press ring is easily adaptable to different diameter sizes. Thus, with the same press jaws workpieces with extremely different diameter sizes can be pressed or crimped together.

The first and the second press jaw of the press device are able to engage the press ring from two different opposing sides to impose a press force what enables the press or crimping process. Thereby the press ring is composed of at least two ring segments that are pivotable affixed to each other. In an open position of the press ring a workpiece that is to be pressed or crimped can be inserted into the press ring and by closing the press ring the press forces are applied onto the workpiece. As a result, the workpieces are mechanically connected.

The first and the second receiving section of the press ring facilitate the engagement of the first and the second engagement section with the press ring. The surfaces of the first and the second receiving section preferably comprise a planar, preferably flat and smooth surface. Thus, a uniform force transmission between the first and the second engagement section and the first and the second receiving section, respectively, is ensured. Besides, a planar surface is more easy to manufacture than any curved or otherwise formed surface.

Preferably, a small rim around the first and the second receiving section ensures a secured engagement without the risk of slipping of the first or the second engagement section. A preferably circular shape of the first and the second receiving section enables an engagement of the press jaws from different angles with respect to the press ring. Thus, it is possible to work from different position while still engaging properly. So, working in small or complicated environments is facilitated.

The shape of the first and the second contact surfaces are adapted to a desired force transmission pattern by at least one convex surface at each of the two contact surfaces. A convex shape of at least a part of the first and the second contact surface enables an even distribution of occurring press forces over a larger area than other contact surfaces designs for example a semi-spherical surface or a surface comprising sharp edges at its ends. In the former case, the forces would be focused and transmitted in only one contact point what would lead to a high stress of the material at that point.

By the claimed radius of curvature the convex surface comprise a rather flat curvature, so that there are no sharp edges while at the same time the contact area of the first and the second contact surface is as large as possible during the press process. By this the contact surfaces of the press jaws are prevented from damage due to unwanted cuts from sharp edges or too much stress in certain areas of the surface of the first and the second receiving section, respectively. This will prolong the lifetime of the press jaws.

Preferably the first and the second contact surface are essentially rectangular in a projection into an x-z-plane and comprise a first convex surface curved around an axis parallel to the z-axis only at a proximal end of the first and the second contact surface, respectively.

Due to the rounded first convex surface at the proximal end of the first and second engagement section, even in a partially open position of the press jaws, no sharp edges are cutting into the surface of a first and second respective receiving section when a force is applied to close the press ring. In case the larger part of the first and the second contact surface is a planar surface, the press forces can be distributed equally over a large area during the press process, particular at the end of the press process where the highest forces occur, what prevents the contact surfaces from damage.

Preferably the first and the second contact surface is essentially rectangular in a projection into an x-z-plane and comprise a first convex surface curved around an axis parallel to the z-axis at the proximal end and a second convex surface curved around an axis parallel to the z-axis at a distal end of the first and the second contact surface and a planar surface in between. In this configuration, sharp edges at the distal and at the proximal end of the first and the second engagement section are prevented while a relatively large flat contact area is remained where the applied forces during a press procedure can distribute equally. An equal distribution of forces over a large area reduces wear off and provides a long lifetime. The rounded first and second convex surface prevent the generation of cuts or grooves on the contact surfaces of the first and the second receiving section and ensure a uniform force transmission in the open position as well as in the closed position of the press jaws.

Preferably the first and the second contact surface are essentially rectangular in a projection into an x-z-plane and comprise one overall convex surface curved around an axis parallel to the z-axis. This configuration like the one before does not comprise any edges at the first and second engagement section of the press jaws, thus, damages to the surface of the first and the second receiving section due to extremely focused forces at edges are prevented. In the open state as well as in the closed state and even if the press jaws are pivoted more than necessary in the direction of the press ring there is always a rounded first and second contact surface that transmits the applied forces more equally and distributed than an edge.

Preferably the first and the second contact surface are further curved around an axis parallel to the x-axis at the right end of the contact surface and are curved around an axis parallel to the x-axis at the left end of the contact surface and are linear in between. With this configuration a rounded first and second contact surface can be obtained that are rounded in the other main direction while there is a relatively large contact area at the center. The large contact area reduces the impact of the acting forces per surface area and prevents the surfaces from damage. The first and second contact surface rounded at their left and right side allow for engaging the first and second receiving section, respectively, at different angles while still avoiding any cuts or grooves on the surfaces of the first and the second receiving section. Thus, wear off is further reduced and the lifetime of the press jaws and thus the press device is increased.

Preferably the first and the second contact surface are further continuously linear in z-direction. This configuration enables the largest contact area during a press process. Due to the fact that the press forces are distributed over a large area stress in certain regions of the first and the second contact surface is reduced what prevents the press jaws from damage.

Preferably the first and the second contact surface are further overall curved around an axis parallel to the x-axis. The resulting barrel-like surface shape enables a rounded first and second contact surface in essentially every engagement direction while at the center there is still the largest contact area so that the occurring press forces can distribute over a large surface area. Furthermore, no sharp edges will damage the surface of the first and the second receiving section, respectively, regardless of the engagement angle with which the first and the second engagement section engages with the respective first and second receiving section.

Preferably the radius of curvature of the first and the second contact surface is preferably larger than twice the width, measured perpendicular to the axis of curvature, more preferably larger than three times the width, and most preferably larger than five times the width, of the respective first and second contact surface. In plain words: the curvature shall be as flat as possible in order to achieve a broad contact area where forces can be transmitted, particular in a vertical direction or in this case the y-direction, from the surfaces of the engagement sections to the surfaces of the receiving sections. As a result, due to the large contact area the stress on each of the surface portions is reduced. Less stress of certain areas or parts of the press device may prolong its lifetime.

Preferably the radius of curvature of the first and the second contact surface is constant. Using this shape a uniform force transmission at every engagement angle is possible.

Preferably the first and the second contact surface comprise a smooth surface. A smooth surface without any non-continuous surface element avoids the generation of unwanted cuts or grooves on the contact surfaced during the press process. Furthermore, the forces are transmitted equally about the whole first and second contact surface, respectively.

Preferably the press jaws further comprise a first and a second connecting member for connecting the first and the second press jaw wherein the first and the second press jaw are pivotally affixed to the first and the second connecting member.

The connection of two press jaws enables an opposite engagement of the press jaws on the press ring. Due to the fact that the first and the second press jaw are pivotally affixed to the first and the second connecting member leverage forces can be used what makes the press process more comfortable since high press forces can be achieved by applying only small forces on the other side of the lever arms, i.e. at the press tool, a handle or the like.

Preferably the first and the second connecting member are arranged at opposite sides of the first and the second press jaw. The arrangement of the first and the second connecting member on both sides of the press jaws serves to keep the press jaws in their predetermined working plane. This enables a symmetrical configuration of the press jaws. Furthermore, the arrangement of two opposite or parallel connecting members leads to a symmetric distribution of the occurring forces what reduces disproportionately high stress of the material in certain areas.

Preferably the first and the second connecting member comprise at least two holes for inserting bolts by which the first and the second press jaw are pivotally affixed to the first and second connecting member. By using bolts as a connection between the press jaws and the connecting members large forces can be applied.

Preferably the first and the second connecting member comprise a hole for connecting the press jaws to a press tool. By providing holes at the connection members a pivotable bolt-connection may be used for connecting the press tool header with a press tool. By such hole for a bolt-connection large forces may be transmitted that facilitate the press process.

The difficulties and drawbacks associated with previous approaches are addressed in the present subject matter as follows.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

In the following preferred embodiments of the present invention are described in more detail with reference to the accompanying figures.

Figure 1:
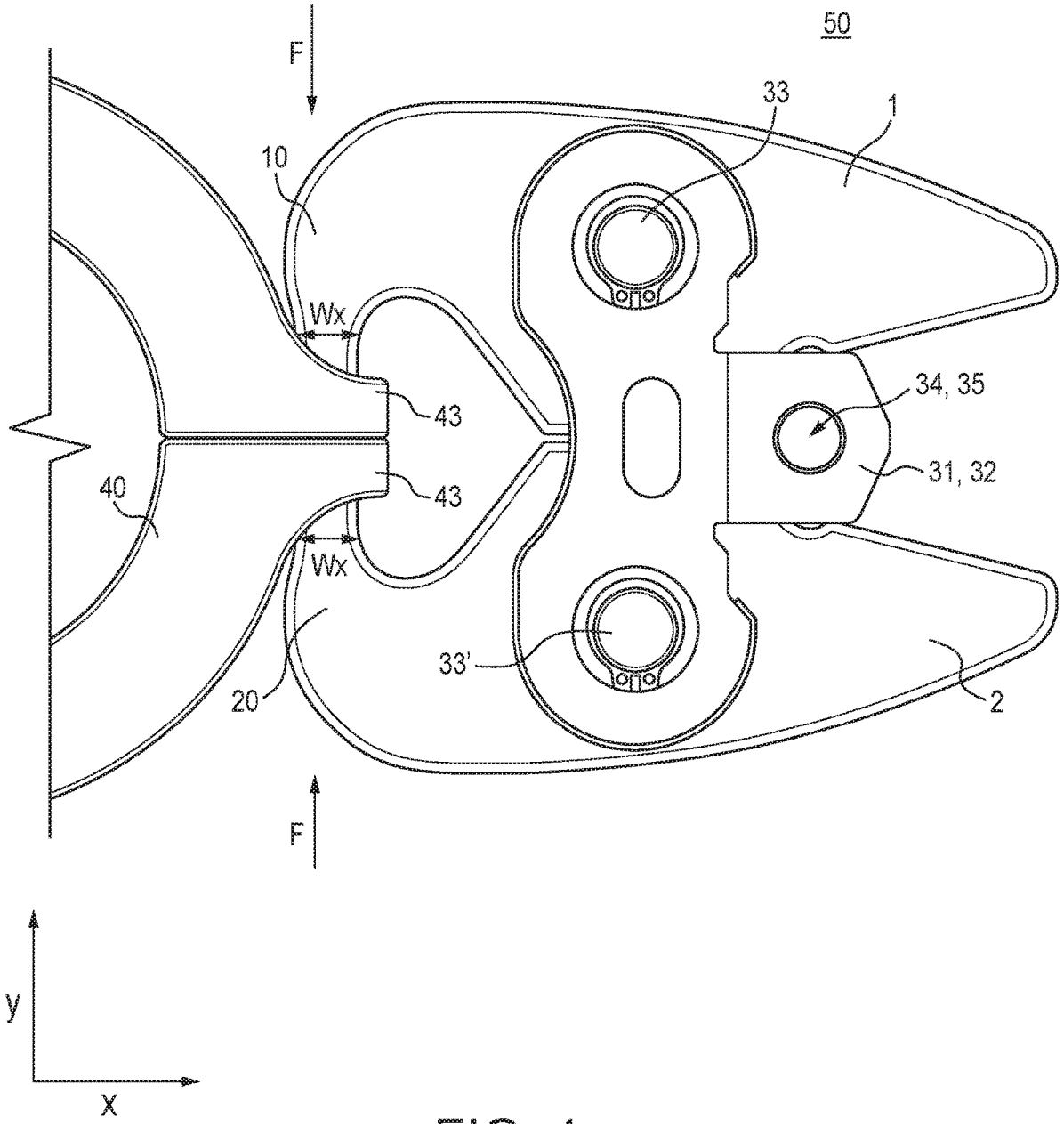
FIG. 1 is a side view in the x-y plane of a schematic illustration of an embodiment of a press device with press jaws in a closed position.
Figure 2:
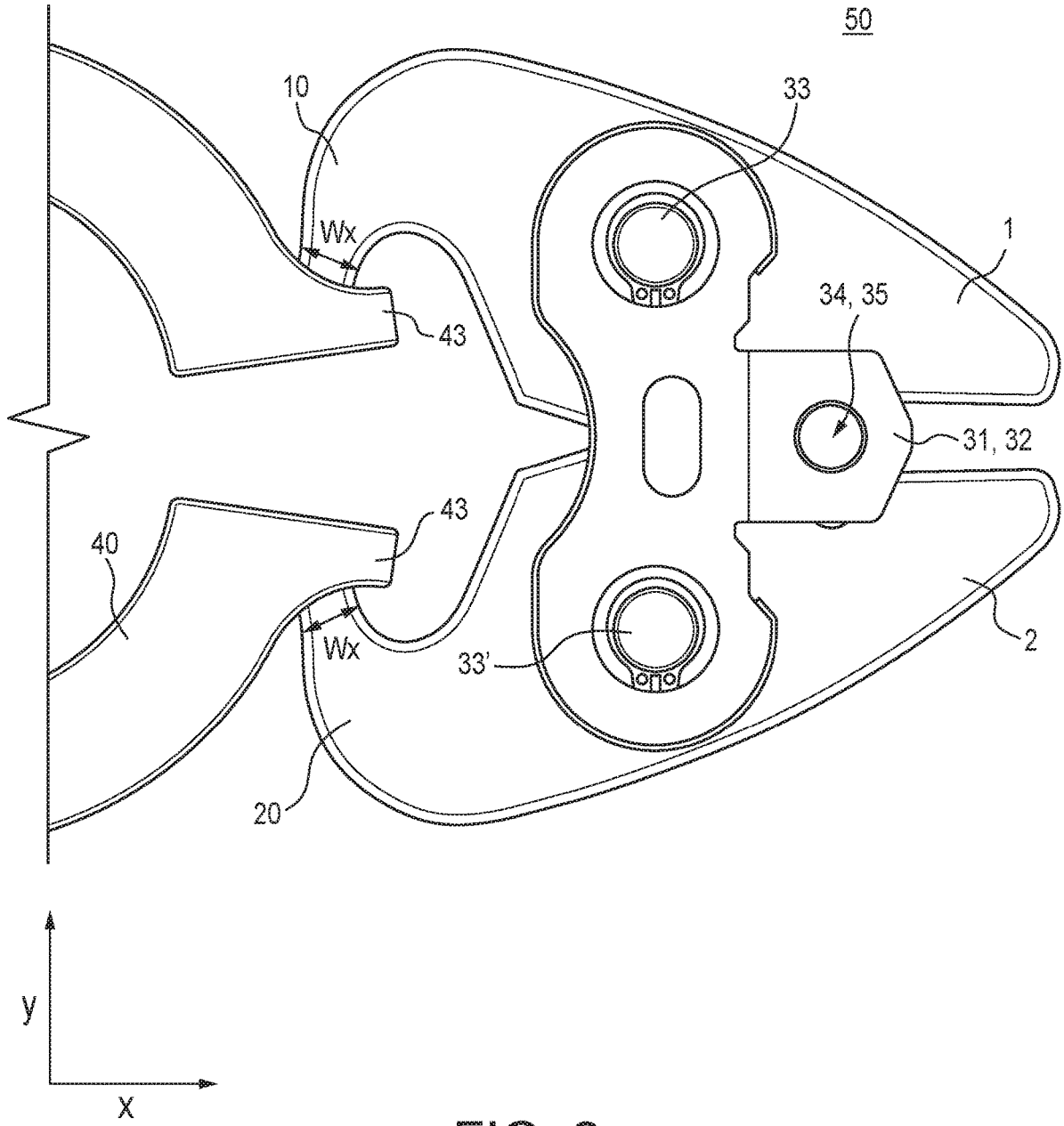
FIG. 2 is a side view in the x-y plane of a schematic illustration of the press device of FIG. 1 in an open position.

FIG. 1 and FIG. 2 show the press jaws 1, 2 and parts of the press ring 40 of the present invention in a closed (FIG. 1) and an open (FIG. 2) position. The press jaws 1, 2 together with the press ring 40 form the press device 50. The press device 50 can be an electric or hydraulic actuated press device 50. In the closed as well as in the open position, the first 10 and the second engagement section 20 of the press jaws 1, 2 are already engaging the first 41 and the second receiving section 42 at the press ring 40. The first 11 and the second contact surface 21 are masked by a small rim 43 at the first 41 and the second receiving section 42. This rim 43, secures the engagement and prevents a slipping of the first 10 and the second engagement section 20 from the first 41 and the second receiving section 42, respectively.

The further elements of a press tool like an electric motor are not shown in the figures but can be connected to the press jaws 1, 2 via a bolt-connection at the holes 34, 35 of the first 31 and the second connecting member 32. Both connecting members 31, 32 are arranged one after another in this view, thus, the second connecting member 32 is masked by the first connecting member 31 but will be visible in further figures. The press jaws 1, 2 are pivotable affixed to the first 31 and the second connecting member 32 via bolt-connections using the bolts 33, 33'. Thus, leverage forces of the press jaws 1, 2 with respect to the first 31 and the second connecting member 32 can be used to press the first 10 and the second engagement section 20 of the press jaws 1, 2 together by a force F and thus close the press ring 40. By closing the press ring 40 a circumferential force is applied onto the surface of the outer tubular workpiece (not shown) that is to be pressed or crimped.

Figure 3:
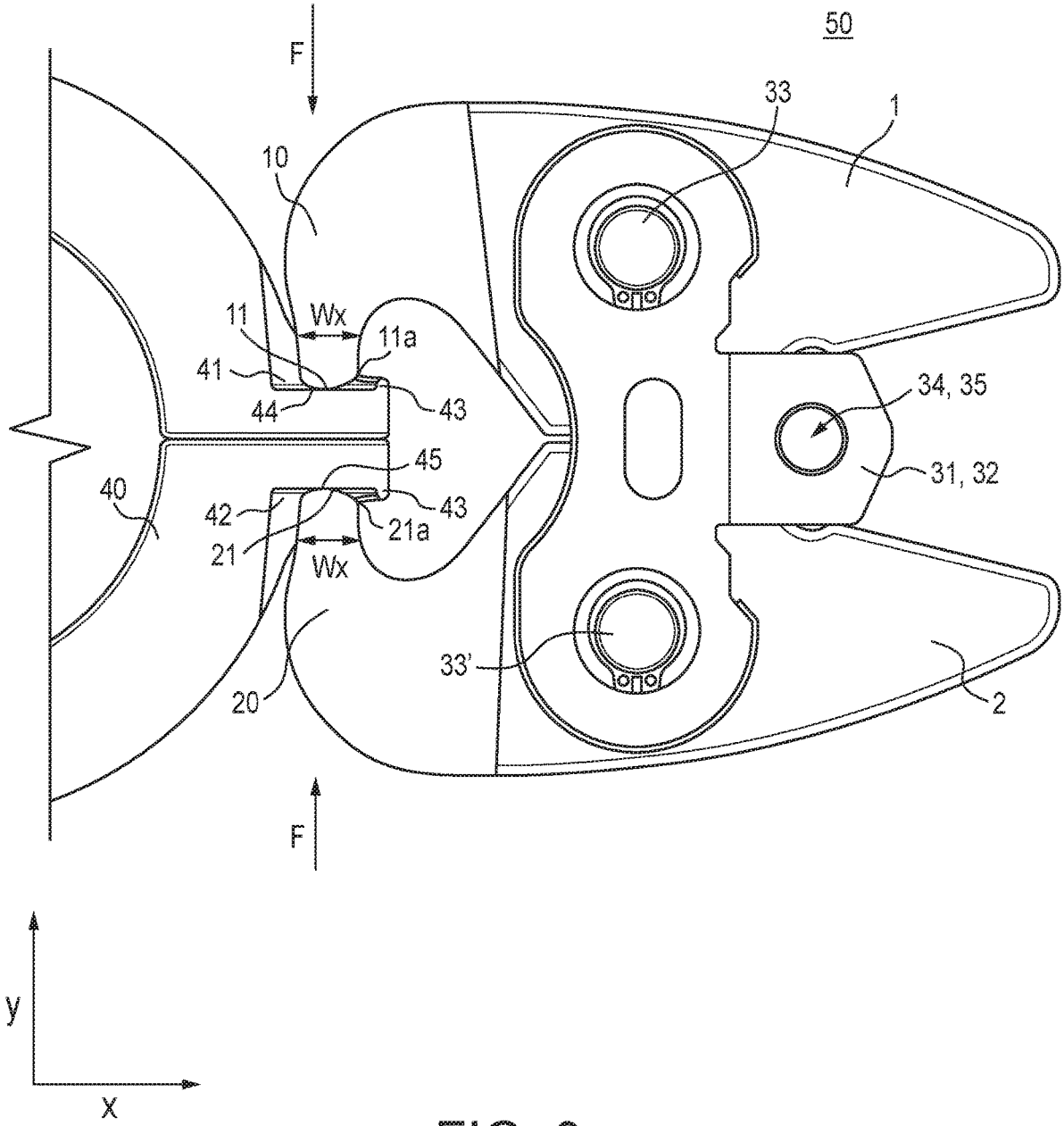
FIG. 3 is a side view in the x-y plane of a partially cut schematic illustration of the press device of FIG. 1 in a closed position to show the contact surfaces.
Figure 4:
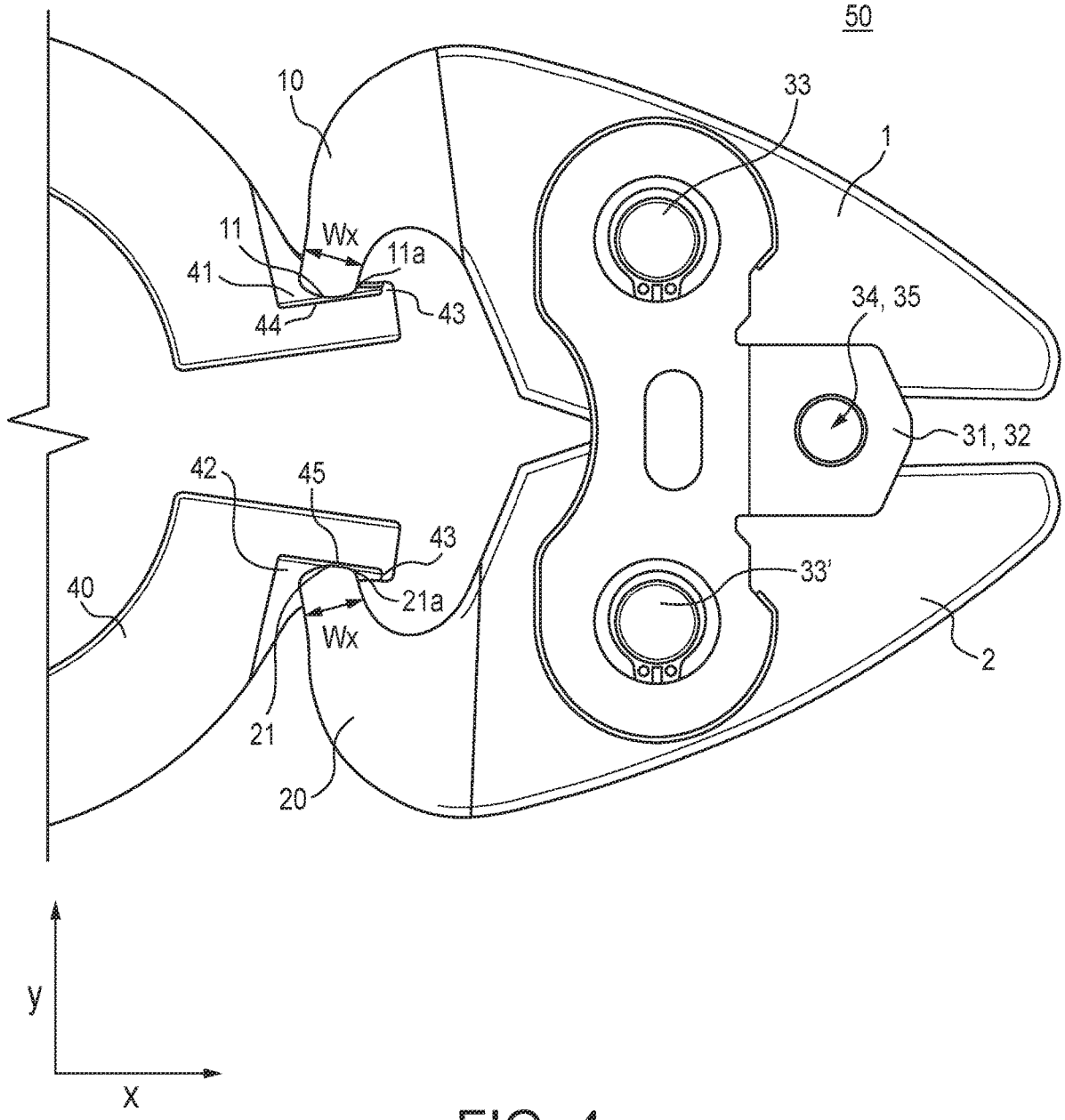
FIG. 4 is a side view in the x-y plane of a partially cut schematic illustration of the press device of FIG. 3 in an open position.

In FIG. 3 and FIG. 4 the above-mentioned rim 43 at the first 41 and the second receiving section 42 of the press ring 40 is partially left out for visualization purposes only. FIG. 3 shows the press ring 40 and the press jaws 1, 2 in a closed position. The first 11 and the second contact surface 21 are in contact with the respective planar first 44 and second 45 surface of the first 41 and second receiving section 42 and provide a large contact area. In FIG. 4 the press jaws 1, 2 and the press ring 40 of the present invention are in an open position. Due to the convex shape of the first 11 and the second contact surface 21 even during engagement of the first 10 and the second engagement section 20 with the first 41 and the second receiving section 42 no sharp edges impact on the planar first 44 and second 45 surface of the respective first 41 and second receiving section 42 but the rounded first 11 and second contact surface 21, for an even transmission of the applied press force F.

Figure 5:
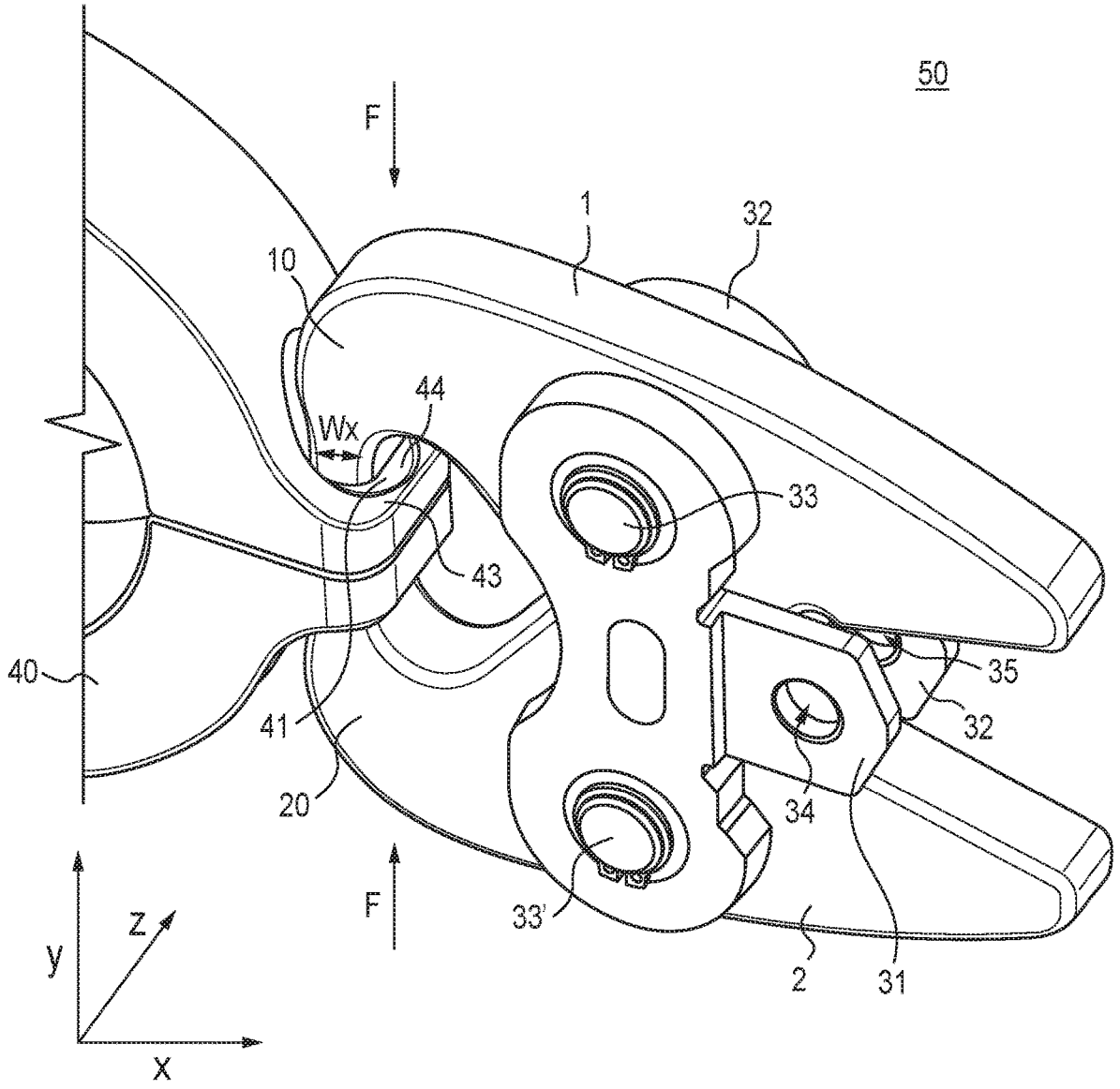
FIG. 5 is a three-dimensional perspective view of a schematic illustration of the press device of FIG. 1 in a closed position.
Figure 6:
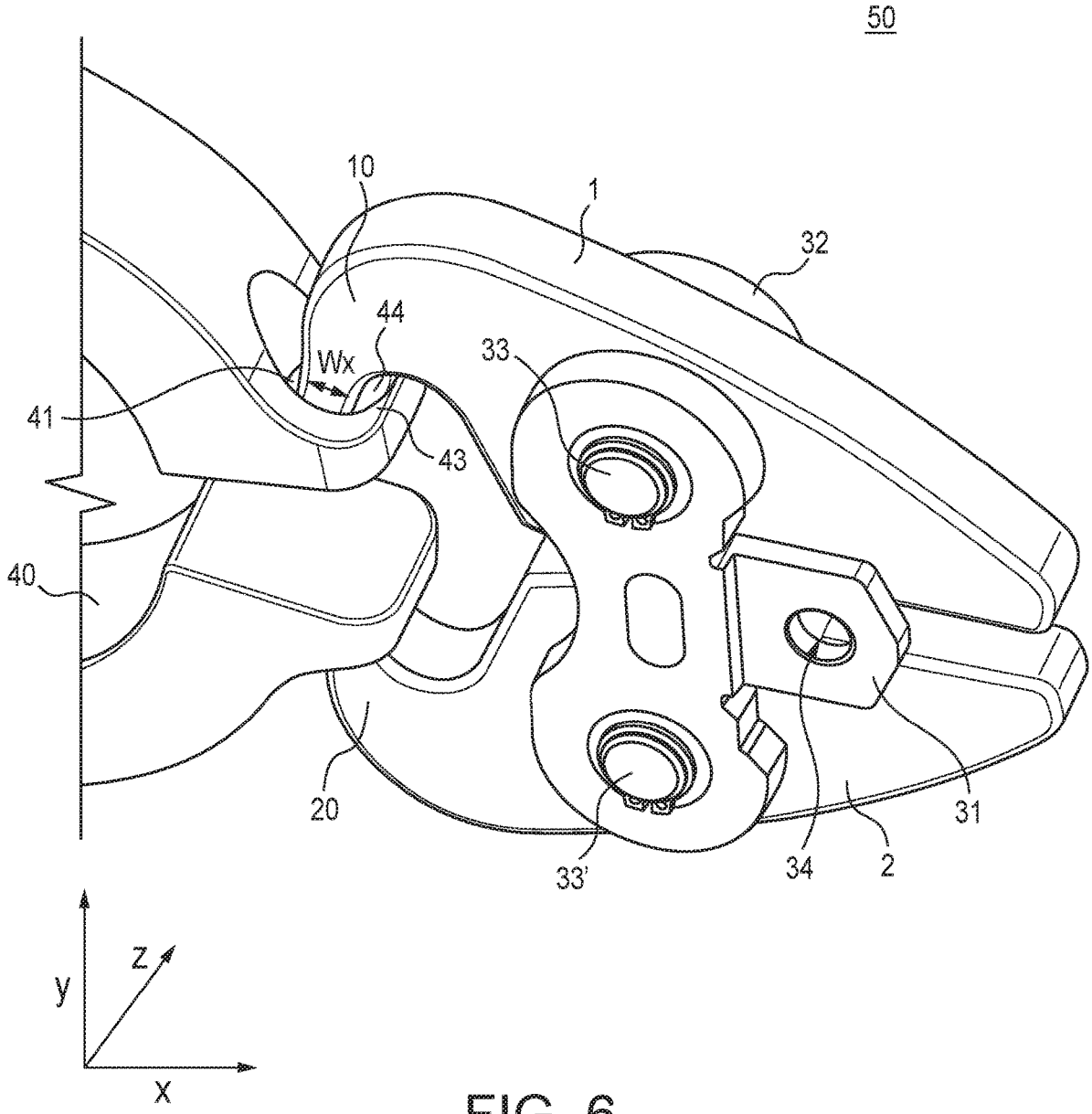
FIG. 6 is a three-dimensional perspective view of a schematic illustration of the press device of FIG. 5 in an open position.

FIG. 5 and FIG. 6 show perspective views of the press jaws 1, 2 and the press ring 40 of the present invention where the second connecting member 32 is now at least partially visible. Furthermore, it can be seen from these figures that the first 41 and the second receiving section 42 comprise a flat and circular shape. Thus, it is possible to engage the first 41 and the second receiving section 42 from different side and different angles by the first 10 and the second engagement section 20 of the press jaws 1, 2.

Figure 7:
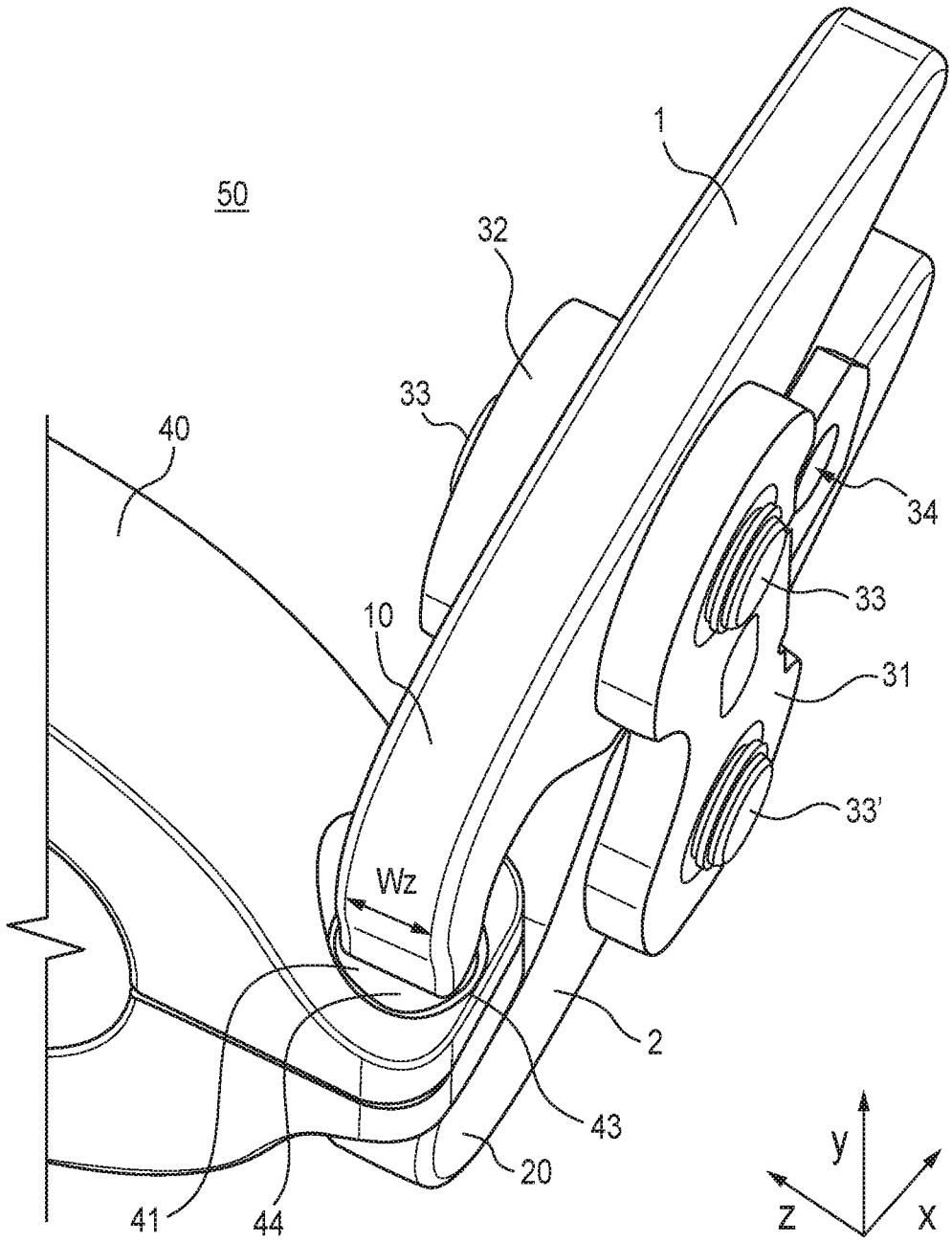
FIG. 7 is a three-dimensional perspective view of a schematic illustration of the press device of FIG. 1 in a closed position while the press jaws engage the press ring at 90° angle.
Figure 8:
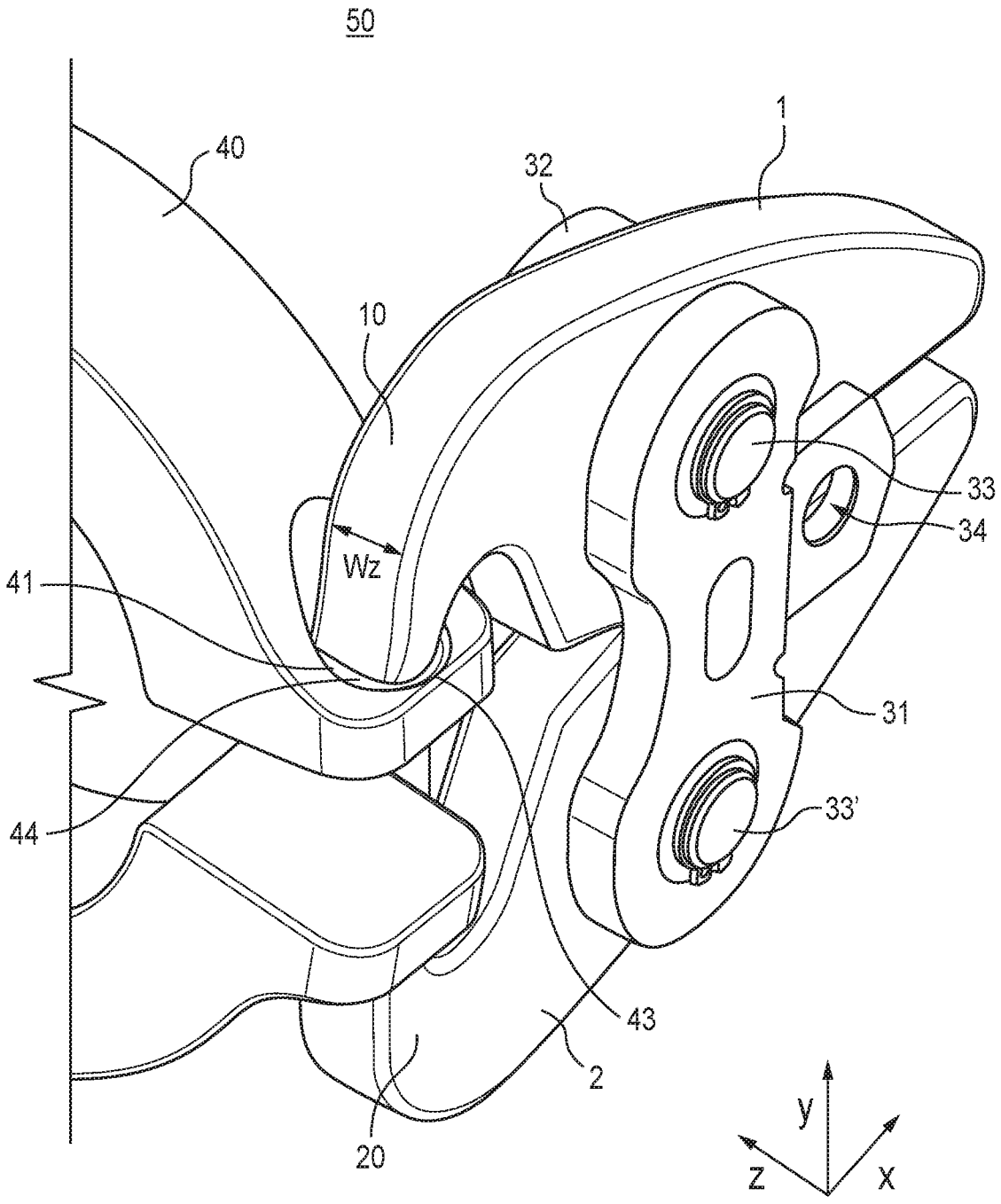
FIG. 8 is a three-dimensional perspective view of a schematic illustration of the press device of FIG. 7 in an open position.

In FIG. 7 and FIG. 8 an engagement of the first 10 and the second engagement section 20 by an angle of about 90 degree with respect to the scenario of FIGS. 5 and 6 is shown. Due to the above-mentioned circular shape of the first 41 and the second receiving section 42 an engagement from different angles is possible.

Figure 9:
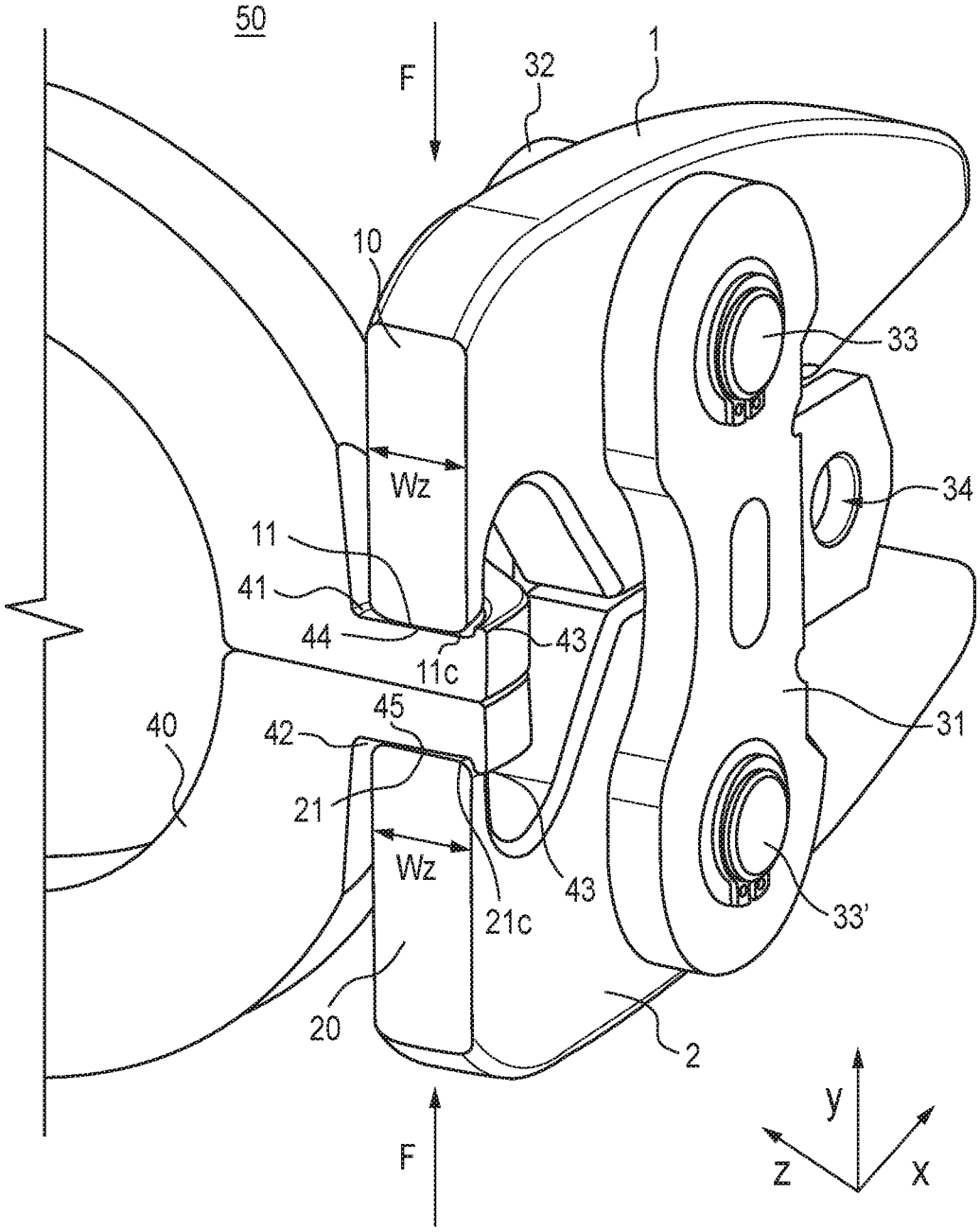
FIG. 9 is a cross-sectional perspective view of a schematic illustration of the press device of FIG. 7 in a closed position.
Figure 10:
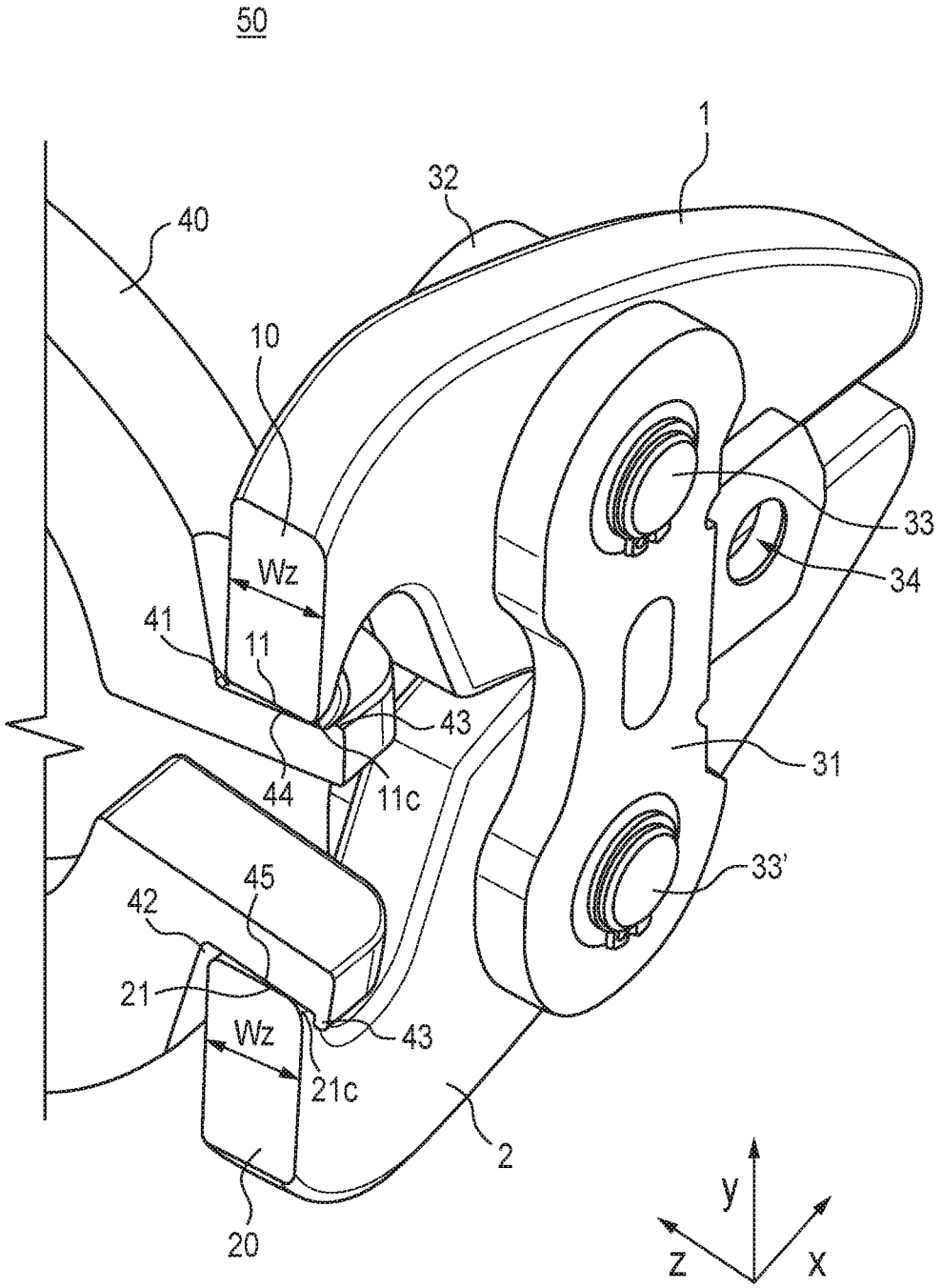
FIG. 10 is a cross-sectional perspective view of a schematic illustration of the press device of FIG. 9 in an open position.
Figure 11:
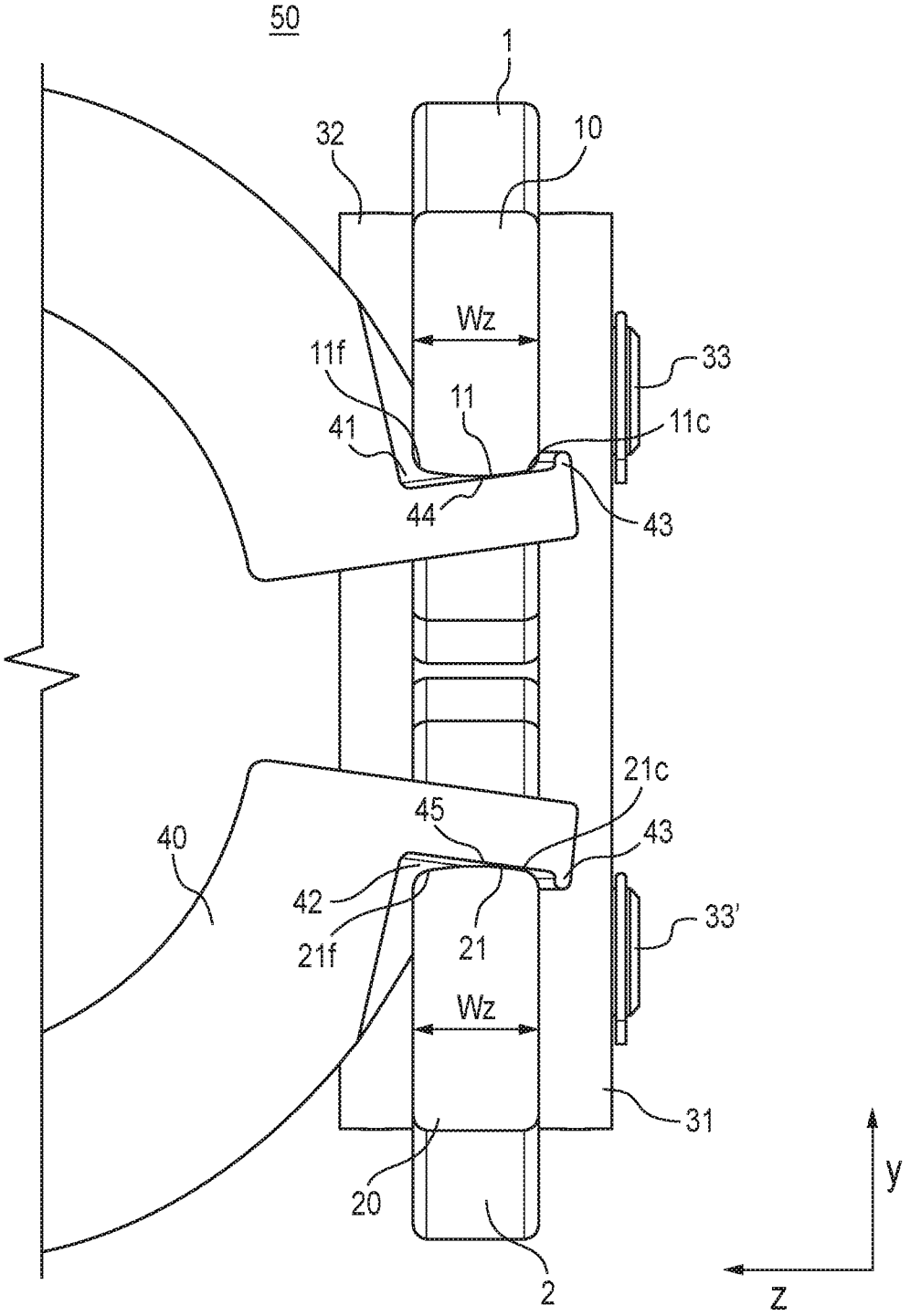
FIG. 11 is a cross-sectional side view of a schematic illustration of the press devices of FIG. 10 in an open position.

In FIGS. 9 to 11 again the rim 43 at the first 41 and the second receiving section 42 is partially left out for visualization purposes only. Especially from FIG. 11 it can be seen that a three-dimensional curved first 11 and second contact surface 21 enables an edge-free engagement of the first 10 and the second engagement section 20 without damaging the planar first 44 and second 45 surface of the respective first 41 and second receiving section 42.

In FIG. 12 different cross-sectional views of embodiments of the first 10 and the second engagement section 20 of the press jaws 1, 2 of the present invention are displayed. Thereby, FIGS. 12*a* to 12*c* show cross-sections in x-direction of the first 10 and the second engagement section 20 of the press jaws 1, 2. Thus the illustrated cross-sectional views show the width Wx of the engagement sections 10, 20. The left side of each cross-section refers to the distal end 14 of the first 10 and the second engagement section 20 of the press jaws 1, 2, i.e. these distal ends 14 are further away from the center of the press jaws 1, 2 than the proximal ends 13. The right sides refer to the proximal end 13 of the first 10 and the second engagement section 20, i.e. these sides are nearer to the center of the press jaws 1, 2 than the distal ends 14. The axis of curvature 60 extends in z-direction. The flatter the contact surface 11, 21, the larger the radius of curvature r and the further away the center of curvature or the axis of curvature 60 resp. lies from the contact surface 11, 21. The same holds for FIGS. 12D to 12F with the only difference that the engagement sections 10, 20 are displayed in the y-z plane. Thus, there the axis of curvature 60 extends in x-direction.

As it can be seen, the first 11 and the second contact surface 21 at the proximal end 13 comprise a first convex surface 11*a*, 21*a*, in order to avoid any damages to the contact surfaces 11 and 21 when closing the press jaws 1, 2. By closing the press jaws 1, 2 the first convex surface 11*a*, 21*a* is in contact with the planar first 44 and second 45 surface of the respective first 41 and second receiving section 42 and adopts different angles when moving the press jaws 1, 2 from the open to the closed position.

Figure 12C:
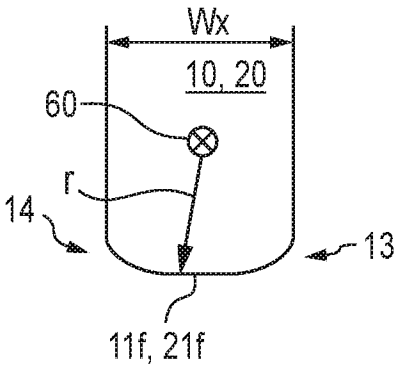
FIG. 12C is a schematic cross-sectional view of the first and second engagement sections of the press jaws with the respective first and second contact surfaces.
Figure 12B:
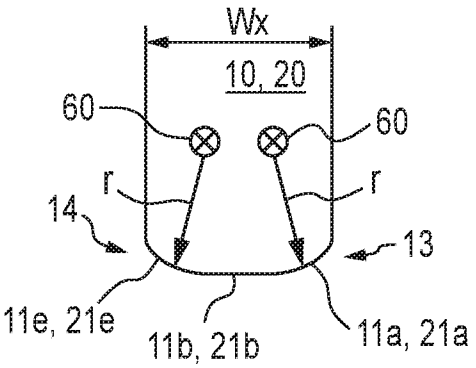
FIG. 12B is a schematic cross-sectional view of the first and second engagement sections of the press jaws with the respective first and second contact surfaces.
Figure 12A:
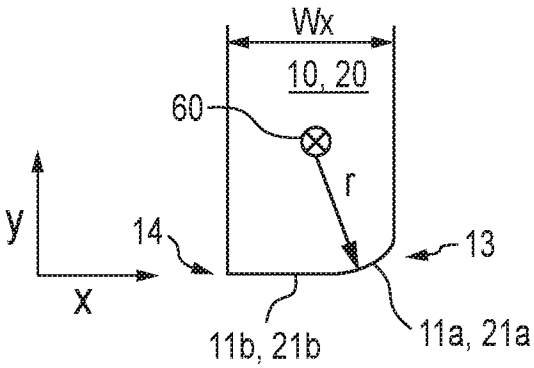
FIG. 12A is a schematic cross-sectional view of the first and second engagement sections of the press jaws with the respective first and second contact surfaces.

FIG. 12*b* shows a first 11 and a second contact surface 21 with a planar surface 11*b*, 21*b* at the center of the surface. With this configuration in the closed position of the jaws 1, 2 the first 11 and second contact surface 21 is maximized for transmitting high pressure forces. At the same time during closing the press jaws 1, 2 no sharp edges are impacting on the planar first 44 and second 45 surfaces of the respective first 41 and second receiving section 42. The same applies for the embodiment shown in FIG. 12*c* where the whole first 11 and second contact surface 21 comprises an overall convex surface 11*f*, 21*f*.

Figure 12F:
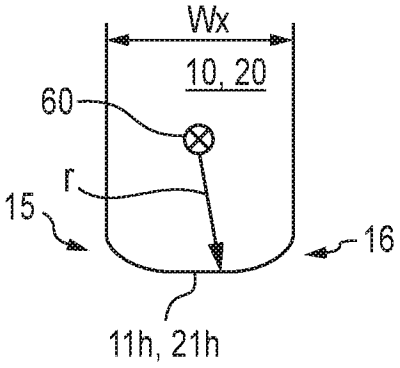
FIG. 12F is a schematic cross-sectional view of the first and second engagement sections of the press jaws with the respective first and second contact surfaces.
Figure 12E:
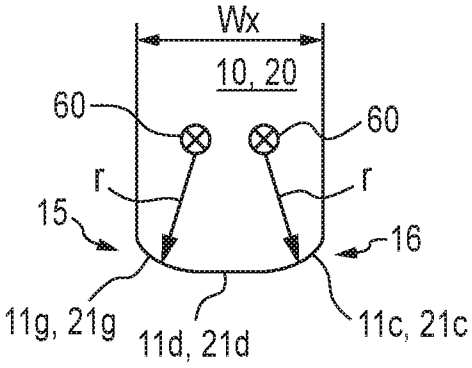
FIG. 12E is a schematic cross-sectional view of the first and second engagement sections of the press jaws with the respective first and second contact surfaces.
Figure 12D:
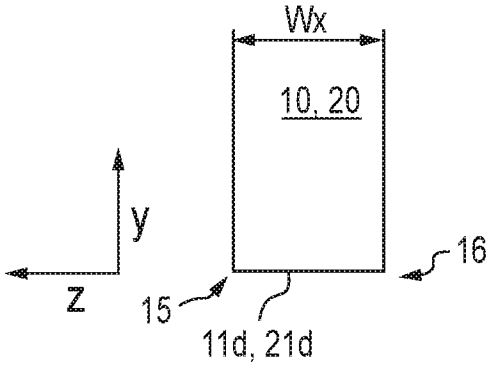
FIG. 12D is a schematic cross-sectional view of the first and second engagement sections of the press jaws with the respective first and second contact surfaces.

FIGS. 12*d* to 12*f* show cross-sectional views of the first 10 and second engagement section 20 of the press jaws 1, 2 in an y-z-plane, i.e. perpendicular to the x-direction. Here, the left sides of the illustrated first 10 and second engagement section 20 refer to the left end 15, and the right sides of the illustrated first 10 and second engagement section 20 refer to the right end 16 of the first 10 and second engagement section 20.

In FIG. 12*d* the first 11 and the second contact surface 21 are further continuously linear 11*d*, 21*d* in z-direction. The linear extension 11*d*, 21*d* enables a large area of contact. Simultaneously it does not impair the operation because the edges at the right 16 and left end 15 of the first 10 and second engagement section 20 do not impact directly on the planar first 44 and second 45 surface of the respective first 41 and second receiving section 42 neither in the open nor in the closed position.

In addition to this convex surface it also possible to further add a right convex surface 11*c*, 21*c* at the right end 16 and a left convex surface 11*g*, 21*g* at the left end 15 of the first 10 and the second engagement section 20 to the first 11 and second contact surface 21 and a linear section 11*d*, 21*d* in between. The resulting barrel-like shaped section illustrated in FIG. 12*e* provides for an engagement of the first 10 and the second engagement section 20 with the first 41 and the second receiving section 42 without any edges and regardless of the actual engagement angle.

The same applies for the embodiment shown in FIG. 12*f* having an overall curved section. The difference between the embodiments of FIG. 12*e* and FIG. 12*f* is the size of the area of contact. This contact area is larger in the embodiment of FIG. 12*e* than in the embodiment of FIG. 12*f*.

Figure 13:
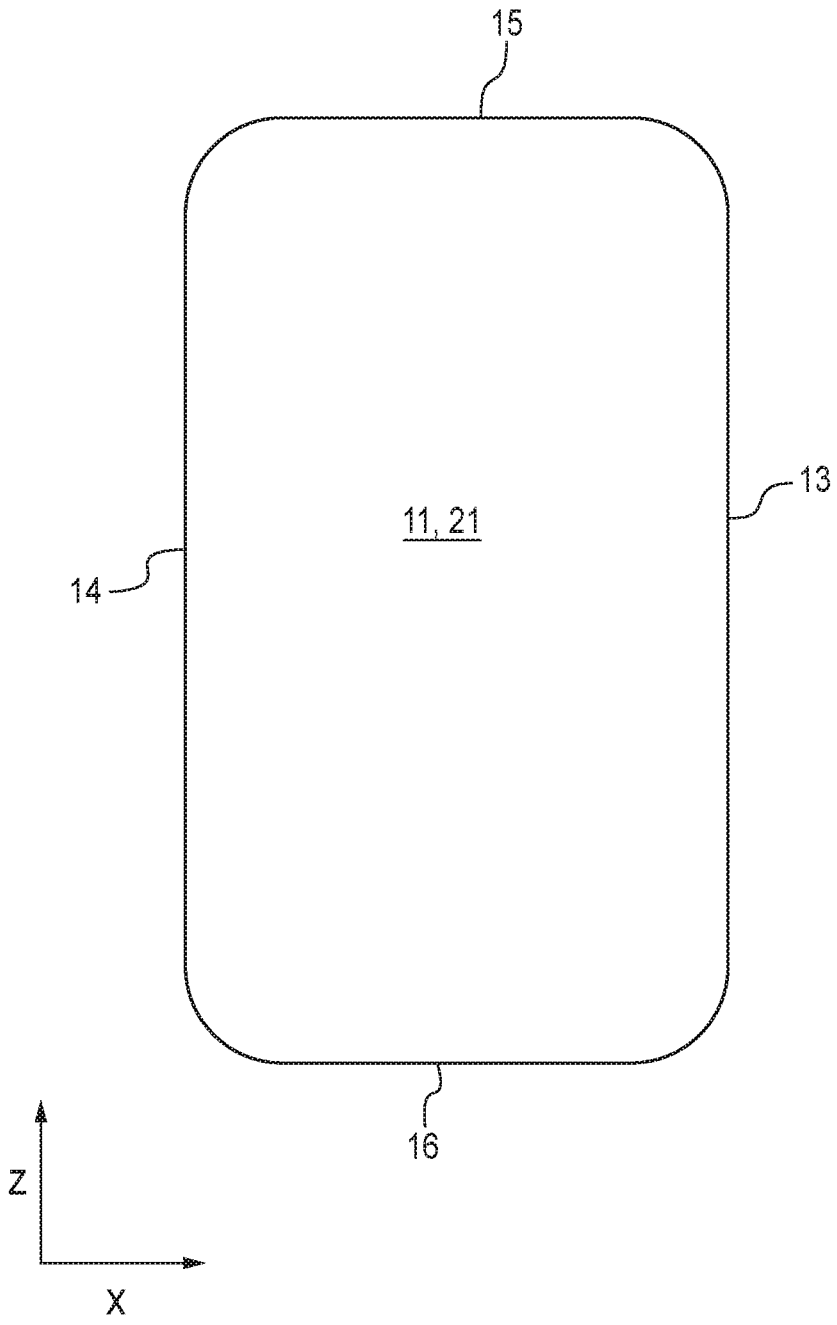
FIG. 13 is a schematic top planar view in the x-z-plane of the first and second contact surface.

FIG. 13 shows a top planar schematic illustration of the first 11 and the second contact surface 21 in an x-z-plane in order to designate the various edges of the contact surfaces 11, 21. The illustrated schematic projection of the at least partially curved first 11 and second contact surface 21 is rectangular with rounded corners. The proximal end is denoted with reference sign 13 and represents the end of the first 10 and second engagement section 20 or first 11 and second contact surface 21, respectively, that are nearest to the center of the press jaws 1, 2. The opposite distal end is denoted by reference sign 14 and represents the end furthest away from the center of the press jaws 1, 2. The left end is denoted by reference sign 15 and the right end is denoted by reference sign 16.

Figure 14:
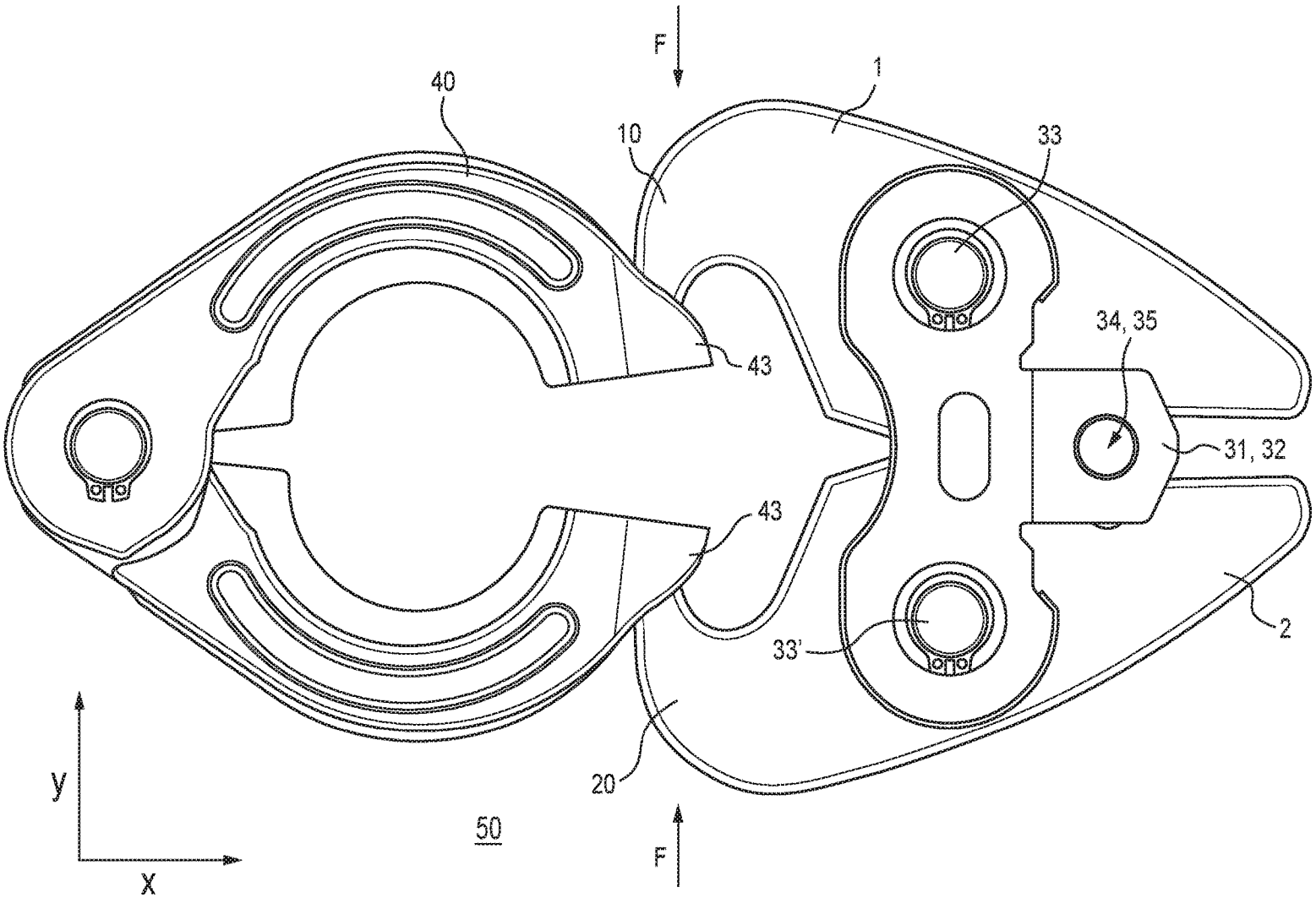
FIG. 14 is a side view in the x-y plane of a schematic illustration of an embodiment of a press device with press jaws and a press ring in an open position.
Figure 15:
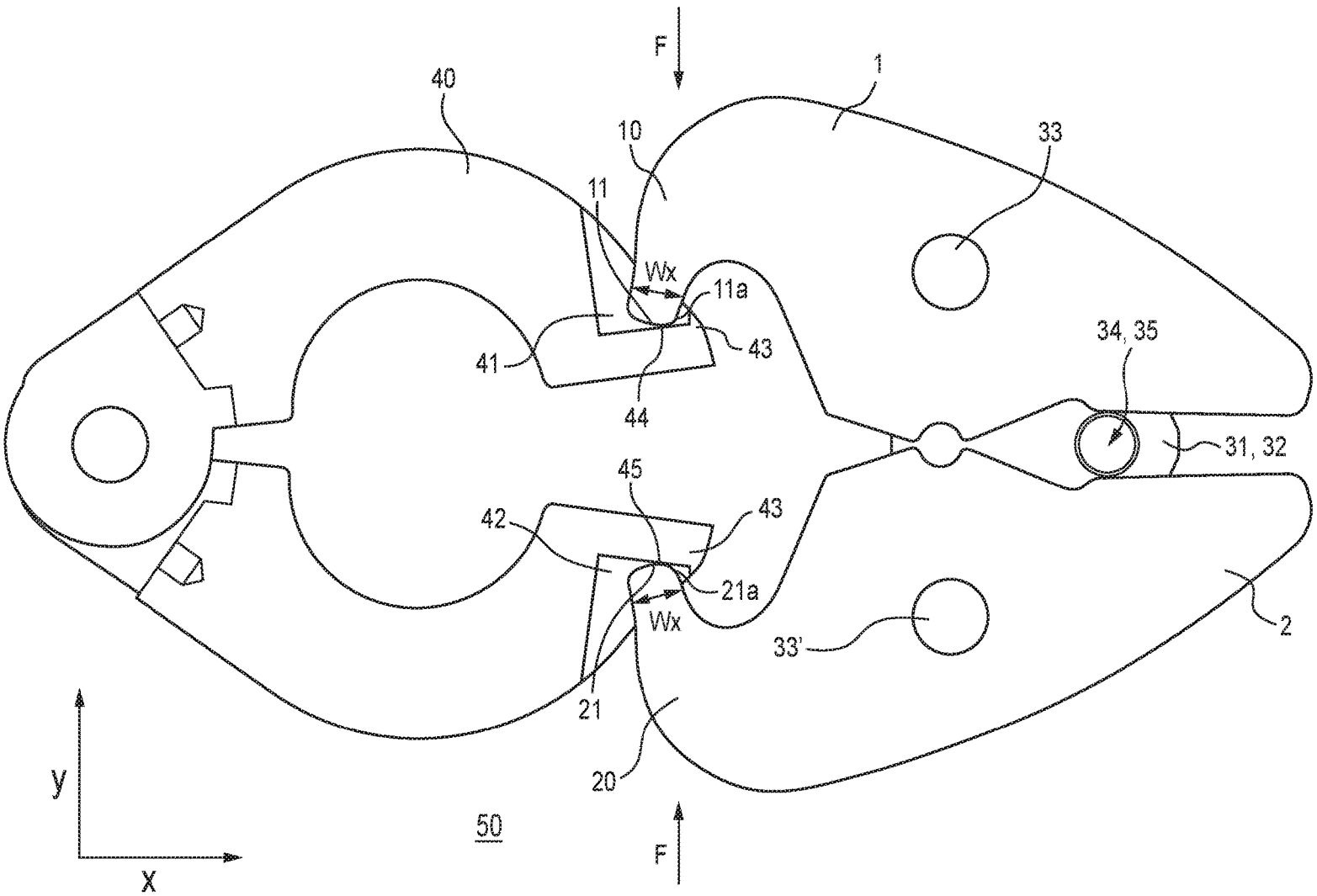
FIG. 15 is a side view in the x-y plane of a partially cut schematic illustration of the press device of FIG. 14 in an open position to show the contact surfaces.

FIG. 14 and FIG. 15 show the complete press device 50 of the present invention comprising the press jaws 1, 2 and the press ring 40. In both Figures the press ring is almost closed, so as if it is arranged around a workpiece (not shown) that is to be pressed or crimped at the inner side/area of the press ring 40. The press ring 40 is composed of at least two ring segments such that it can be largely opened to insert the workpiece in between the ring segments. After inserting the workpiece, the press ring 40 is arranged around large areas of the circumference of the workpiece and only a small portion at the right side of the press ring 40 in FIGS. 14 and 15 is left open. The resulting gap is then closed by using the press jaws and applying a force F to close the press ring 40 and thus mechanically combine/connect the workpiece with another workpiece (also not shown). Thereby, as it can be seen best in FIG. 15, always only rounded or curved contact surfaces 11, 21 of the engagement sections 10, 20 engage with the receiving sections 41, 42 and equally transmit the force F to close the press ring 40.

LIST OF REFERENCE SIGNS

1 first pivotable press jaw
2 second pivotable press jaw
10 first engagement section
11 first contact surface
11*a*, 11*c* first convex surface (first contact surface)
11*e*, 11*g* second convex surface (first contact surface)
11*f*, 11*h* overall convex surface (first contact surface)
11*b*, 11*d* planar surface (first contact surface)
13 proximal end
14 distal end
15 left end
16 right end
20 second engagement section
21 second contact surface
21*a*, 21*c* first convex surface (second contact surface)
21*e*, 21*g* second convex surface (second contact surface)
21*f*, 21*h* overall convex surface (second contact surface)
21*b*, 21*d* planar surface (second contact surface)
31 first connecting member
32 second connecting member
33, 33' bolt
34 hole in first connecting member
35 hole in second connecting member
40 press ring
41 first receiving section
42 second receiving section
43 rim
44 first surface (first receiving section)
45 second surface (second receiving section)
50 press device
60 axis of curvature
r radius of curvature
F Press force x, y, z cartesian dimensions
Wx width in x-dimension
Wz width in (originally) z-dimension Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A press device, comprising:

a press ring for pressing together tubular workpieces in between; and at least a first and a second pivotable jaw;

wherein the first jaw comprises a first engagement section and the second jaw comprises a second engagement section; and the press ring comprises a first and a second receiving section for receiving the first and the second engagement section of the first and second jaws, respectively;

wherein a first and a second surface of the first and the second receiving section, respectively, contact the first and the second engagement section, respectively, each of the first and the second surfaces comprising a planar surface; and the first engagement section comprises a first contact surface and the second engagement section comprises a second contact surface, wherein the first and the second contact surface oppose each other for applying a press force (F);

wherein the first contact surface and the second contact surface each comprise at least one convex surface;

wherein the at least one convex surface of the first contact surface and the at least one convex surface of the second contact surface oppose each other;

wherein each radius of curvature (r) of the first and the second contact surface is larger than half a width (Wx, Wz), measured perpendicular to an axis of curvature, of the respective first and second contact surface;

wherein the first and the second contact surface are further curved around an axis parallel to the x-axis at the right end of the first and the second contact surface, respectively, and are further curved around an axis parallel to the x-axis at the left end of the first and the second contact surface, respectively, and are linear in between.

2. The press device according to claim 1, wherein the first and the second contact surface are rectangular in a projection into an x-z-plane and comprise a first convex surface curved around an axis parallel to the z-axis only at a proximal end of the first and the second contact surface, respectively.

3. The press device according to claim 1, wherein the first and the second contact surface are rectangular in a projection into an x-z-plane and comprise one overall convex surface curved around an axis parallel to the z-axis.

4. The press device according to claim 1, wherein the first and the second contact surface are further continuously linear in z-direction.

5. The press device according to claim 1, wherein the first and the second contact surface are curved around an axis parallel to the x-axis.

6. The press device according to claim 1, wherein the radius of curvature (r) of the first and the second contact surface is larger than twice the width (Wx, Wz), measured perpendicular to the axis of curvature of the respective first and second contact surface.

7. The press device according to claim 6, wherein the radius of curvature (r) of the first and the second contact surface is larger than three times the width (Wx, Wz) measured perpendicular to the axis of curvature of the respective first and second contact surface.

8. The press device according to claim 7, wherein the radius of curvature (r) of the first and the second contact surface is larger than five times the width (Wx, Wz) measured perpendicular to the axis of curvature of the respective first and second contact surface.

9. The press device according to claim 1, wherein the radius of curvature of the first and the second contact surface is constant.

10. The press device according to claim 1, wherein the first and the second contact surface comprise a smooth surface.

11. The press device according to claim 1, further comprising:

a first and a second connecting member for connecting the first and the second press jaw;

wherein the first and the second press jaw are pivotally affixed to the first and the second connecting member.

12. The press device according to claim 11, wherein the first and the second connecting member are arranged at opposite sides of the first and the second press jaw.

13. The press device according to claim 11, wherein the first and the second connecting member comprise at least two holes for inserting bolts by which the first and the second press jaw are pivotally affixed to the first and second connecting member.

14. The press device according to claim 11, wherein the first and the second connecting member comprise a hole for connecting the press jaws to a press tool.

15. A press device, comprising:

a press ring for pressing together tubular workpieces in between; and at least a first and a second pivotable jaw;

wherein the first jaw comprises a first engagement section and the second jaw comprises a second engagement section; and the press ring comprises a first and a second receiving section for receiving the first and the second engagement section of the first and second jaws, respectively;

wherein a first and a second surface of the first and the second receiving section, respectively, contact the first and the second engagement section, respectively, each of the first and the second surfaces comprising a planar surface; and the first engagement section comprises a first contact surface and the second engagement section comprises a second contact surface, wherein the first and the second contact surface oppose each other for applying a press force (F);

wherein the first and the second contact surface are rectangular in a projection into an x-z-plane and comprise a first convex surface curved around an axis parallel to the z-axis at the proximal end and a second convex surface curved around an axis parallel to the z-axis at a distal end of the first and the second contact surface, respectively, and a planar surface in between;

wherein the first convex surface of the first contact surface and the first convex surface of the second contact surface oppose each other;

wherein each radius of curvature (r) of the first and the second contact surface is larger than half a width (Wx, Wz), measured perpendicular to an axis of curvature, of the respective first and second contact surface.

* * * * *